US008753134B1

(12) United States Patent
Lai

(10) Patent No.: US 8,753,134 B1
(45) Date of Patent: Jun. 17, 2014

(54) OUTDOOR POWER SOCKET HAVING A RECESSED PART TO ACCOMMODATE A CONNECTION ELEMENT FOR ATTACHING A PROTECTIVE LID

(71) Applicant: Li-Chun Lai, New Taipei (TW)

(72) Inventor: Li-Chun Lai, New Taipei (TW)

( * ) Notice: Subject to any disclaimer, the term of this patent is extended or adjusted under 35 U.S.C. 154(b) by 53 days.

(21) Appl. No.: 13/685,494

(22) Filed: Nov. 26, 2012

(51) Int. Cl.
*H01R 13/44* (2006.01)

(52) U.S. Cl.
USPC ..... 439/131

(58) Field of Classification Search
USPC ..... 439/131, 135, 367; 174/37–39, 58–60; 361/334, 641
See application file for complete search history.

(56) References Cited

U.S. PATENT DOCUMENTS 5,914,460 A * 6/1999 Mowery et al. ..... 174/50
6,127,630 A * 10/2000 McKenzie et al. ..... 174/58
6,667,437 B2 * 12/2003 Schenk ..... 174/38
7,341,463 B2 * 3/2008 Lai ..... 439/131
7,361,832 B2 * 4/2008 Dively ..... 174/38
7,807,924 B2 * 10/2010 Wurzer ..... 174/59
7,999,419 B2 * 8/2011 Drane et al. ..... 307/326
2007/0284370 A1 * 12/2007 Dively ..... 220/3.8

* cited by examiner

*Primary Examiner* — Chandrika Prasad
(74) *Attorney, Agent, or Firm* — Ming Chow; Sinorica, LLC

(57) ABSTRACT

An outdoor power socket having protective lid structure is disclosed, comprising a socket body, a connection element including positioning pillars, a protective lid, a pivotal axle and a torsion spring. Herein the pivotal axle is used to combine the protective lid with the connection element, and the protective lid can be flipped over the connection element. Moreover, an electric power socket is installed on the front case of the socket body, and a combination part is set up on one side of the power socket. In this way, it is possible to combine the positioning pillar of the connection element into the positioning part of the front case of the socket body such that the fixation pillar on the connection element penetrates the fixation hole of the combination part thereby allowing the protective lid to cover or open the power socket.

6 Claims, 9 Drawing Sheets

OUTDOOR POWER SOCKET HAVING A RECESSED PART TO ACCOMMODATE A CONNECTION ELEMENT FOR ATTACHING A PROTECTIVE LID

BACKGROUND OF THE INVENTION

1. Field of the Invention

The present invention generally relates to an outdoor power socket having protective lid structure; in particular, the present invention relates to a protective lid structure specifically installed on an outdoor power socket thereby preventing raindrops or other foreign objects from entering into the power socket.

2. Description of Related Art

Extension line electric power sockets are comprehensively used in people's daily lives because they can solve the issue about insufficient number of power sockets in a house or office which may be annoying for electrical devices applications, thus that such extension line electric power sockets can be found almost everywhere.

Taking the outdoor lighting as an example, since the extension line power socket may be required to be placed outdoor in order to provide outdoor illumination devices with electric power, for users needing long-term outdoor power supply, the extension line power socket would be inevitably disposed outdoor for a long duration of time. However, because general extension line power sockets do not provide the water-proof feature, especially for outdoor utilizations, it is hence for sure that weather factors will definitely cause adverse consequences thereon. Therefore long-term exposures to sunlight or rainfall may easy lead to malfunctions in such extension line power sockets.

Accordingly, a common solution for this situation is to immediately unplug the extension line power socket upon completion of use and store it indoor; when it is needed to be used again, retrieve and install it in place as demand. Certainly, this approach will cause inconvenience in operation, and the extension line power socket may still become unusable if it is not taken back in time but rather left exposed to outdoor environment.

As a result, it would be an optimal solution suppose it is possible to configure a protective structure on the power socket such that, when needed, the user is allowed to open the power socket; on the other hand, upon completion of use, the power socket can be shielded thereby effectively preventing malfunction conditions caused by weather factors due to long-term exposures to outdoor environment.

SUMMARY OF THE INVENTION

As such, the present invention intends to provide an outdoor power socket having protective lid structure, in which a protective structure is configured on the power socket such that, when needed, the user is allowed to open the power socket; on the other hand, upon completion of use, the power socket can be shielded thereby effectively preventing malfunction conditions caused by weather factors due to long-term exposures to outdoor environment.

An outdoor power socket having protective lid structure according to the present invention can achieve the aforementioned objectives, comprising: a socket body, in which the upper end thereof is formed by the combination of a front case and a rear case, a plurality of power sockets are installed on the front case and one side of the power sockets has a recessed combination part, and in which a positioning part is at least installed on the combination part and at least a side of the positioning part is configured with a fixation hole; a connection element, whose left and right sides are configured in protrusion with a first connection part and a second connection part, in which the first connection part and the second connection part respectively includes an open hole and an axial rod laterally extends from an end of the first connection part toward the second connection part, which axial rod having a through hole penetrating to the open hole in the first connection part, and in which a positioning pillar at least extends from the bottom of the connection element and a fixation pillar extends from at least a side of the positioning pillar; a protective lid, whose bottom is configured with an accommodation part, in which the left and the right sides of the accommodation part respectively includes a pivotal hole such that the first connection part and the second connection part of the connection element can be received between the two pivotal holes of the accommodation part, and the positions of the open holes in the first connection part and the second connection part correspond to the pivotal hole of the accommodation part; a pivotal axle, which penetrates the two pivotal holes of the protective lid, the open holes of the first connection part and the second connection part as well as the through hole of the axial rod such that the protective lid and connection element can be combined and the protective lid can be flipped over the connection element; and a torsion spring, which is sleeve installed on the axial rod and includes two endpoints, in which one of the endpoints is fixed to the connection element and the other one is fixed onto the accommodation part of the protective lid such that the protective lid enables an auto-restoration feature.

In accordance with the present invention, the positioning pillar of the connection element can be combined into the positioning part of the front case of the socket body such that the fixation pillar on the connection element can penetrate the fixation hole of the combination part thereby allowing the protective lid to cover or open the power socket.

More specifically, the bottom of the aforementioned socket body is combined with a cone through which the socket body can be fixed to outdoor ground.

More specifically, the positioning part of the aforementioned socket body is a notch and a hole is configured at the bottom surface of the notch, in which a screw hole is configured in the positioning pillar of the connection element such that the positioning pillar can be received within the notch and the screw hole of the positioning pillar corresponds to the hole in the notch so that the connection element can be fixed into the combination part on one side of the socket body by means of through screw fixations.

More specifically, the depth of the aforementioned notch determines the insertion distance of the fixation pillar of the connection element into the socket body.

More specifically, the two sides on the positioning part of the aforementioned socket body are respectively configured with a fixation hole and the two sides on the positioning pillar of the connection element are respectively configured with a fixation pillar such that, upon combining the positioning pillar with the positioning part, the fixation pillar penetrates and closes the fixation hole thereby firmly combining the connection element into the combination part.

More specifically, the aforementioned pivotal axle includes a cap part and an axle part, in which the axle part extends from the cap part so the cross-section of the pivotal axle generally demonstrates a "T" shape, and the axle part penetrates the two pivotal holes of the protective lid, the open holes of the first connection part and the second connection part as well as the through hole of the axial rod such that the protective lid and connection element can be combined and the protective lid can be flipped over the connection element.

DETAILED DESCRIPTION OF THE PREFERRED EMBODIMENTS

Figure 1:
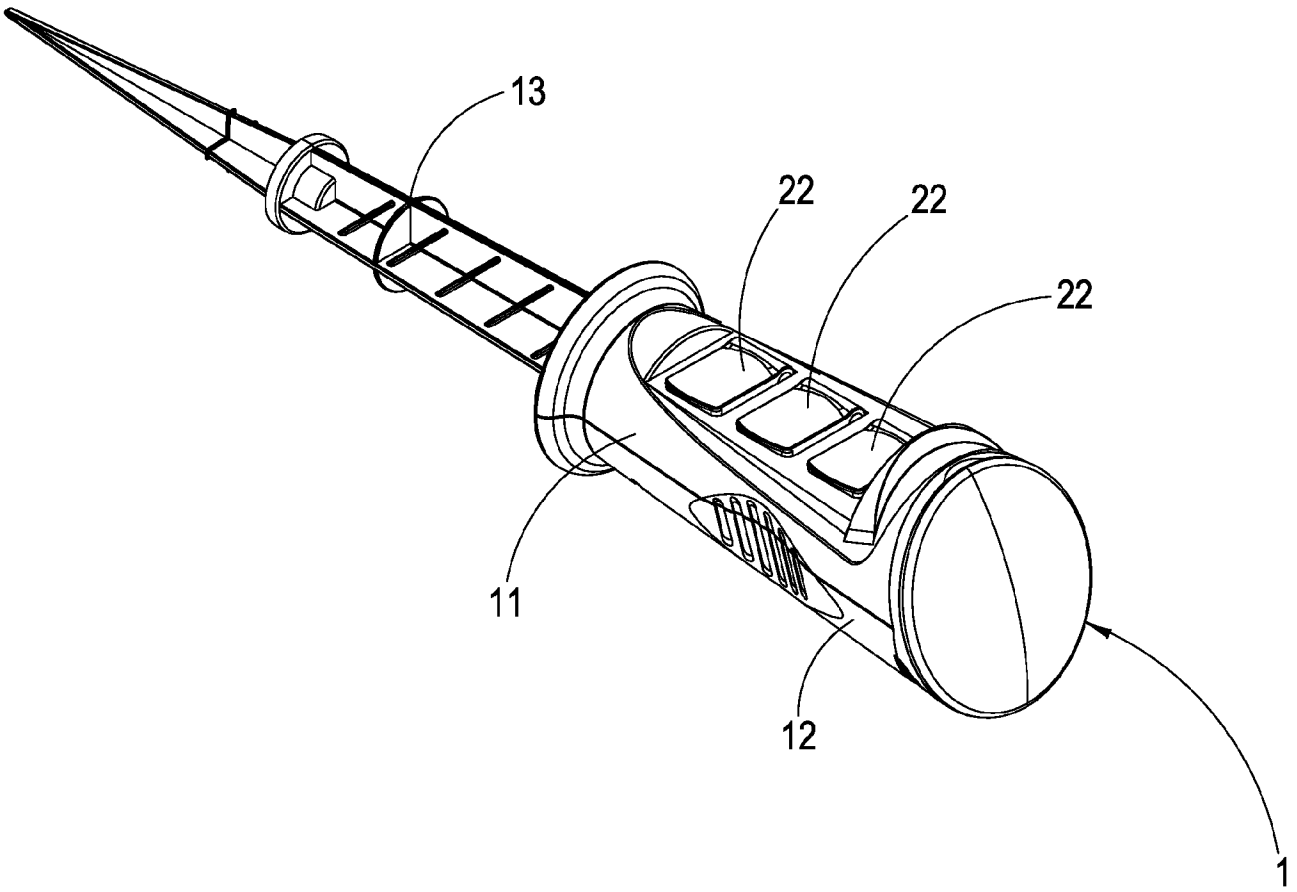
FIG. 1 shows an integral structure view of the outdoor power socket having protective lid structure according to the present invention.
Figure 2:
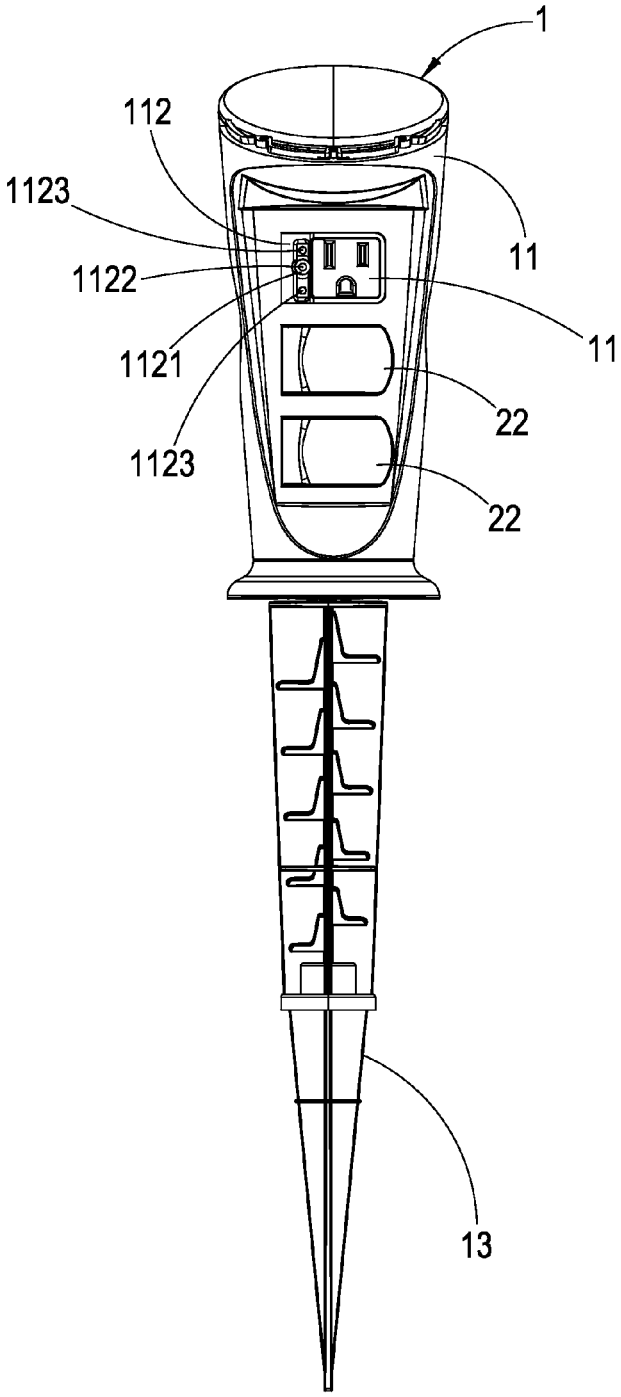
FIG. 2 shows a front side structure view of a socket body in the outdoor power socket having protective lid structure according to the present invention.

The aforementioned and other technical contents, aspects and effects in relation with the present invention can be clearly appreciated through the detailed descriptions concerning the preferred embodiments of the present invention in conjunction with the appended drawings.

Refer first to FIGS. 1, 2, 3A, 3B and 3C, wherein an integral structure view, a front side structure view for a socket body and a disassembled structure view of the outdoor power socket having protective lid structure according to the present invention are respectively shown. From FIGS. 1 and 2, it can be seen that the power socket comprises a socket body 1 in which the upper end of the socket body 1 is formed by the combination of a front case 11 and a rear case 12, a plurality of power sockets 111 are installed on the front case 11 and one side of the power sockets 111 has a recessed combination part 112, and in which a positioning part 1121 is at least installed on the combination part 112, the positioning part 1121 is a notch, a hole 1122 is configured at the bottom surface of the notch, and each of the two sides of the positioning part 1121 is configured with a fixation hole 1123. Moreover, the bottom end of the socket body 1 is combined with a cone 13 thereby allowing the socket body 1 to be fixed to outdoor ground through the cone 13.

Figure 3A:
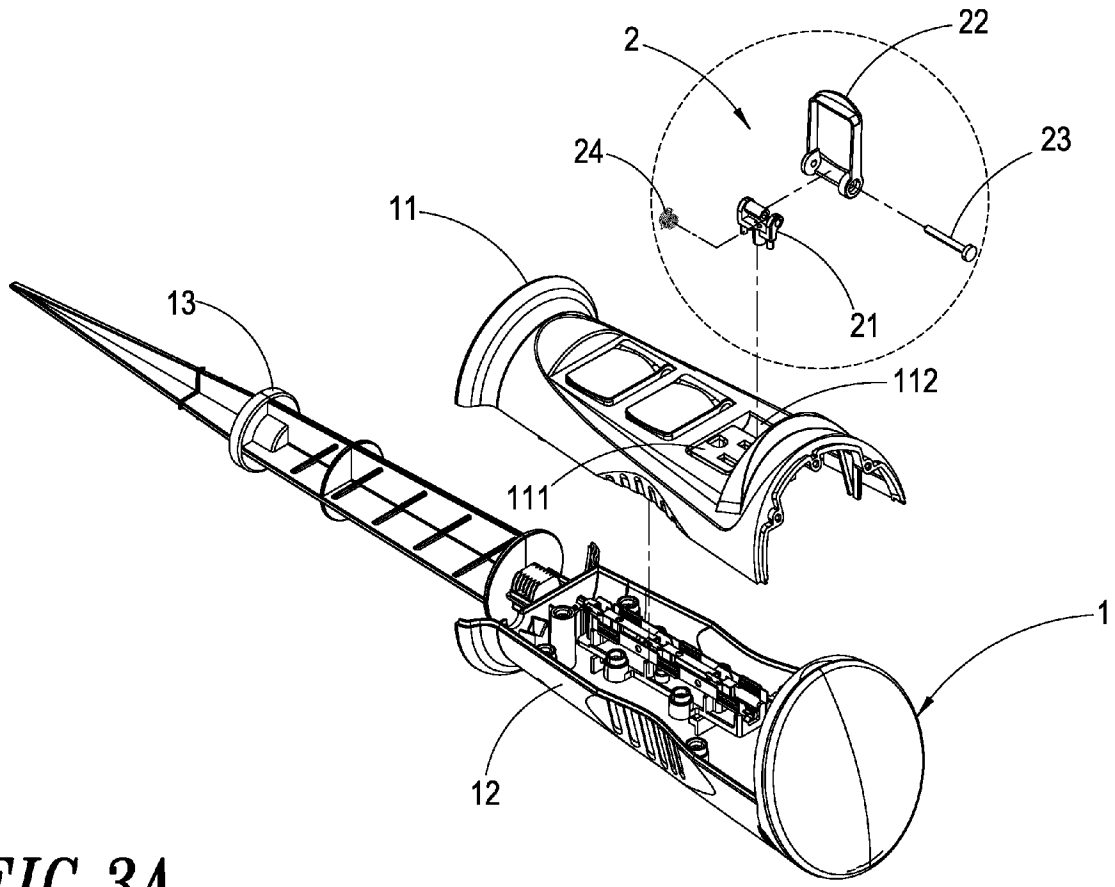
FIG. 3A shows a disassembled structure combination view of the outdoor power socket having protective lid structure according to the present invention.
Figure 3B:
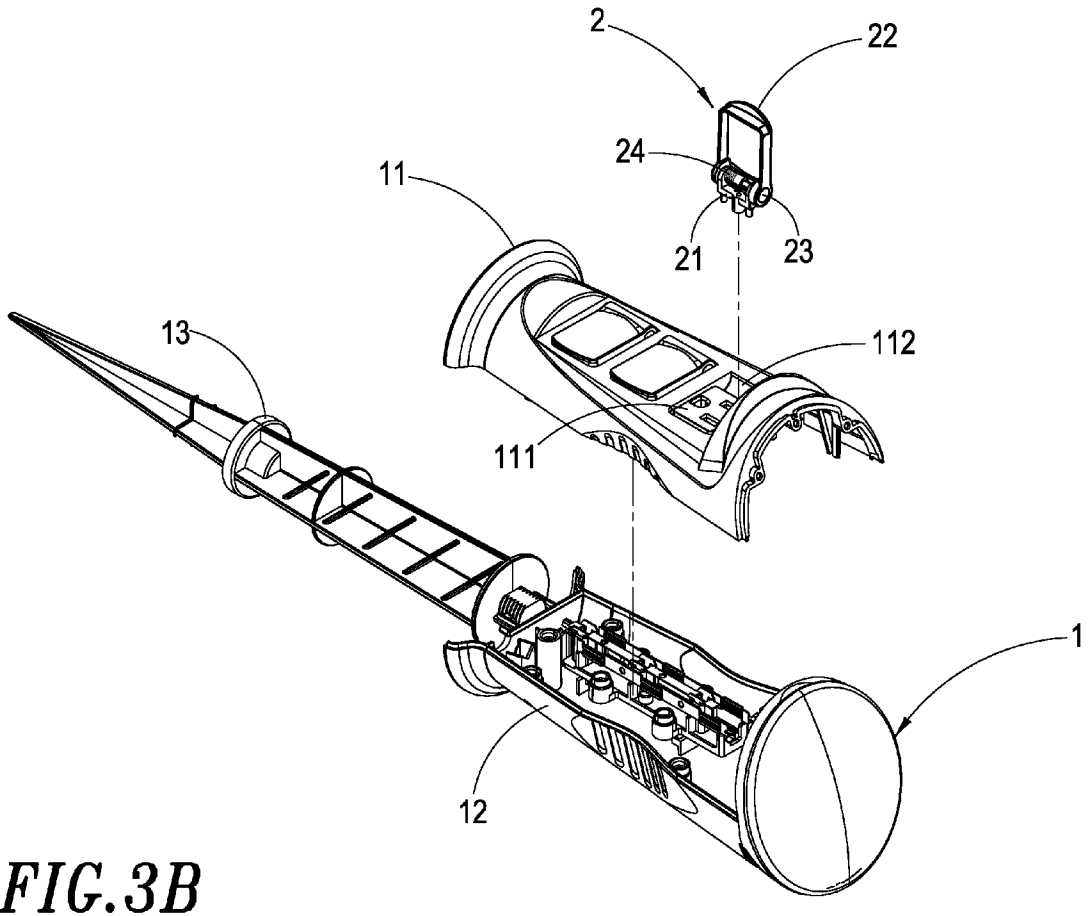
FIG. 3B shows a disassembled structure view of the outdoor power socket having protective lid structure according to the present invention.
Figure 3C:
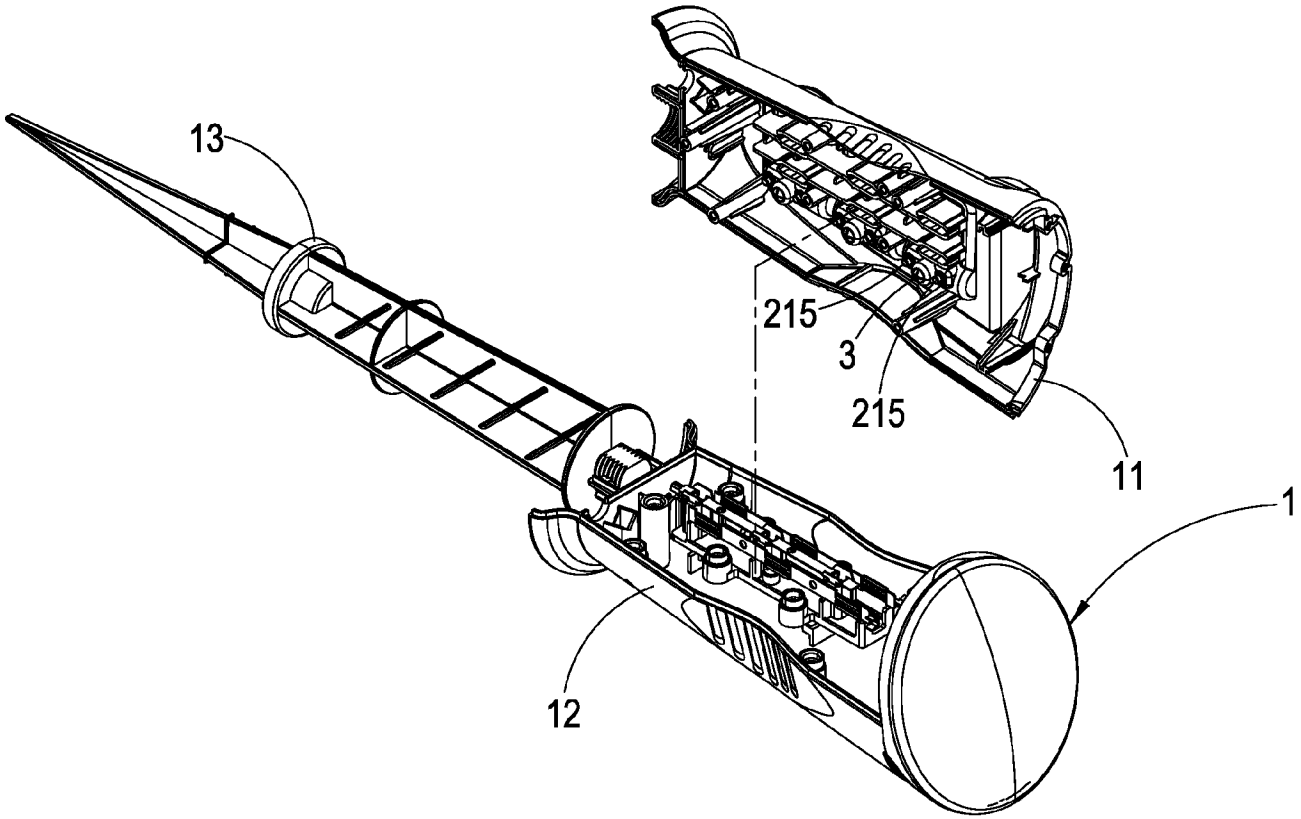
FIG. 3C shows a disassembled structure view of the outdoor power socket having protective lid structure according to the present invention.

Also, from FIGS. 3A, 3B and 3C, it can be appreciated that the protective lid structure 2 comprises a connection element 21, a protective lid 22, a pivotal axle 23 and a torsion spring 24, and by combining such connection element 21, protective lid 22, pivotal axle 23 and torsion spring 24, it can be fixed into the combination part 112; besides, the left and right sides of the connection element 21 are configured in protrusion with a first connection part 211 and a second connection part 212, in which the first connection part 211 and the second connection part 212 respectively include an open hole 2111, 2121 and an axial rod 213 laterally extends from an end of the first connection part 211 toward the second connection part 212, which axial rod 213 having a through hole 2131 penetrating to the open hole 2111 in the first connection part 211. In addition, a positioning pillar 214 at least extends from the bottom of the connection element 21 and each of the two sides of the positioning pillar is installed with a fixation pillar 215, in which a screw hole 2141 is configured in the positioning pillar 214 such that the positioning pillar 214 can be received inside the positioning part 1121 (a notch), and the screw hole 2141 of the positioning pillar 214 corresponds to the hole 1122 of the positioning part 1121 such that the connection element 21 can be fixed into the combination part 112 on one side of the socket body 1 by means of the through screw fixation of a screw 3.

Figure 4A:
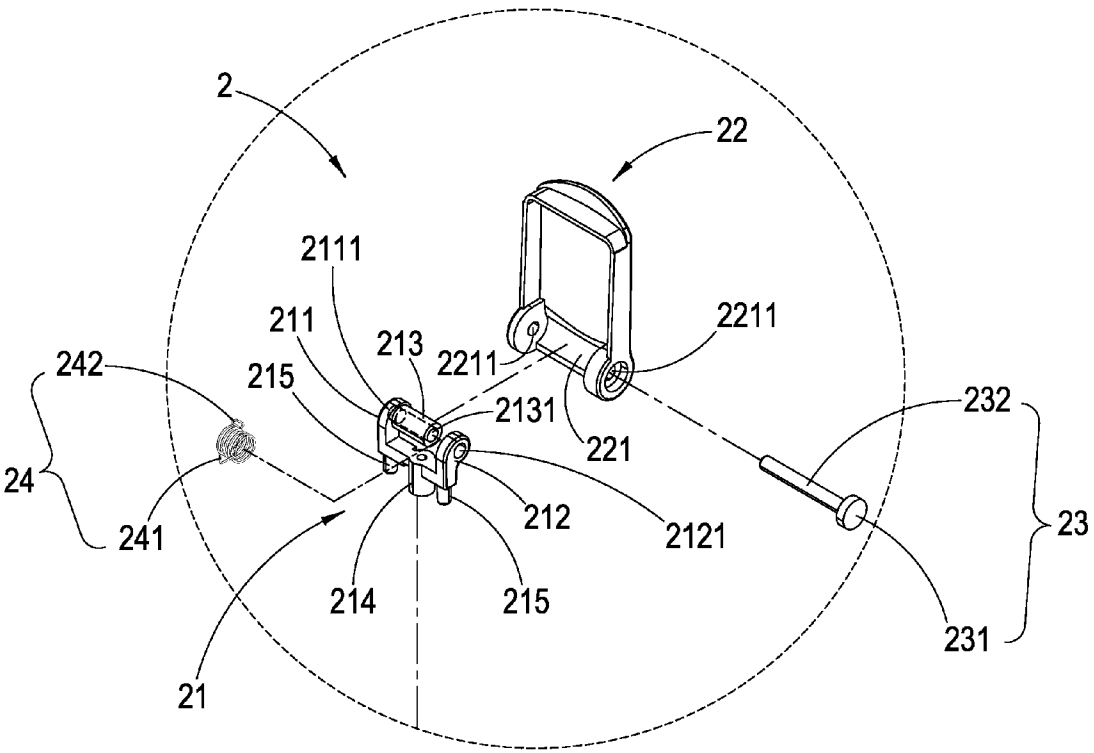
FIG. 4A shows a disassembled structure view of the protective lid structure in the outdoor power socket having protective lid structure according to the present invention.
Figure 4B:
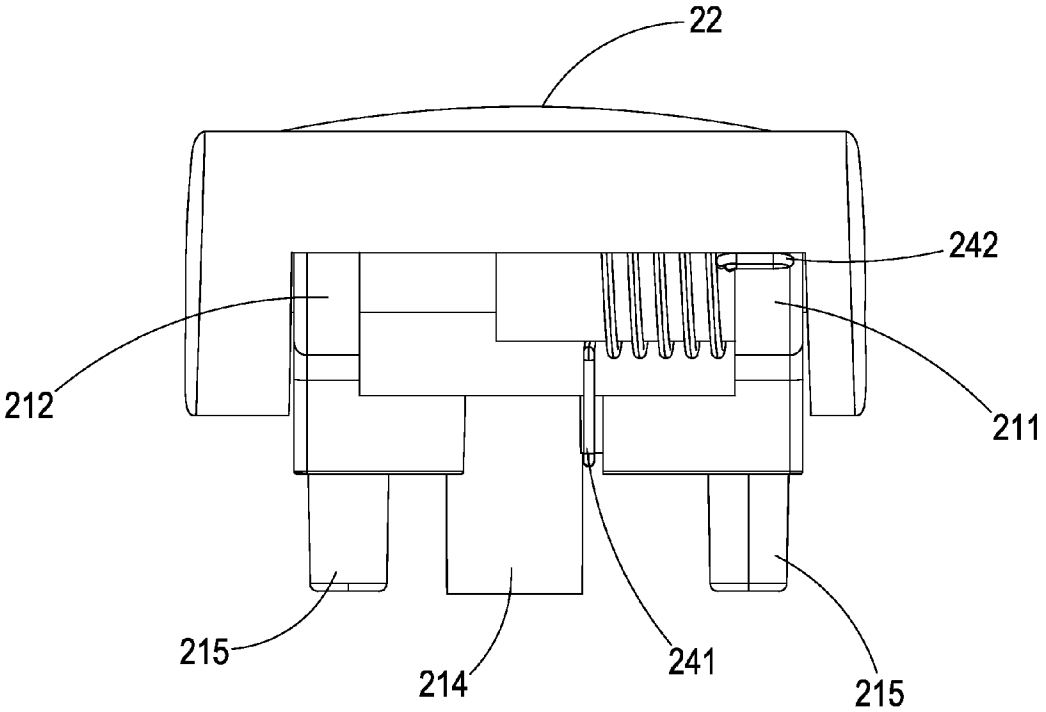
FIG. 4B shows a connection structure view of a torsion spring in the outdoor power socket having protective lid structure according to the present invention.

Meanwhile, the connection element 21 can be combined with the protective lid 22 by means of a pivotal axle 23, as shown in FIGS. 4A and 4B, in which an accommodation part 221 is configured at the bottom of the protective lid 22, and the left and right sides of the accommodation part 221 are respectively configured with a pivotal hole 2211, such that the first connection part 211 and the second connection part 212 of the connection element 21 can be received between the two pivotal holes 2211 of the accommodation part 221, and the positions of the open holes 2111, 2121 in the first connection part 211 and the second connection part 212 correspond to the pivotal holes 2211 of the accommodation part 221.

Figure 5A:
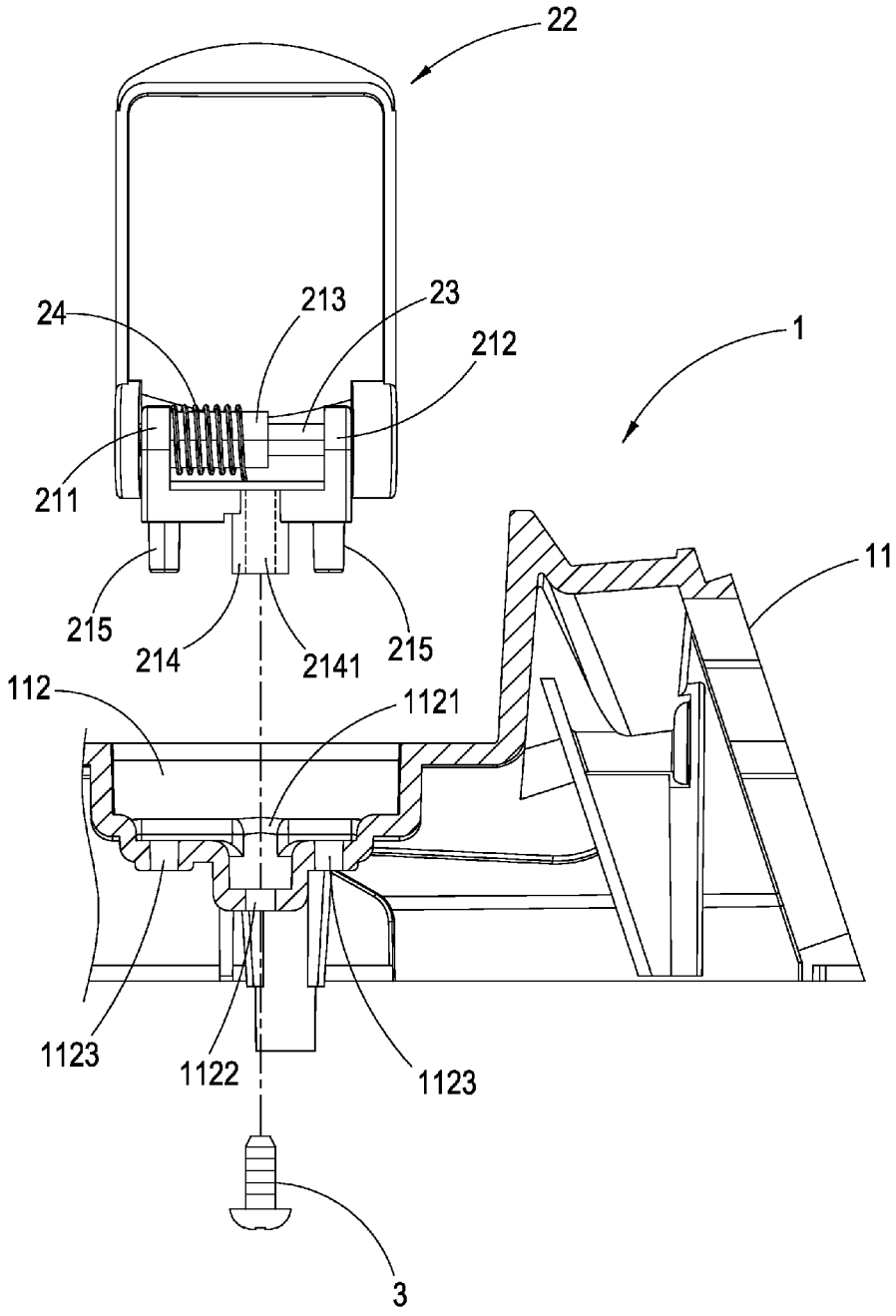
FIG. 5A shows a cross-section view for the combination of the protective lid structure and the socket body in the outdoor power socket having protective lid structure according to the present invention.
Figure 5B:
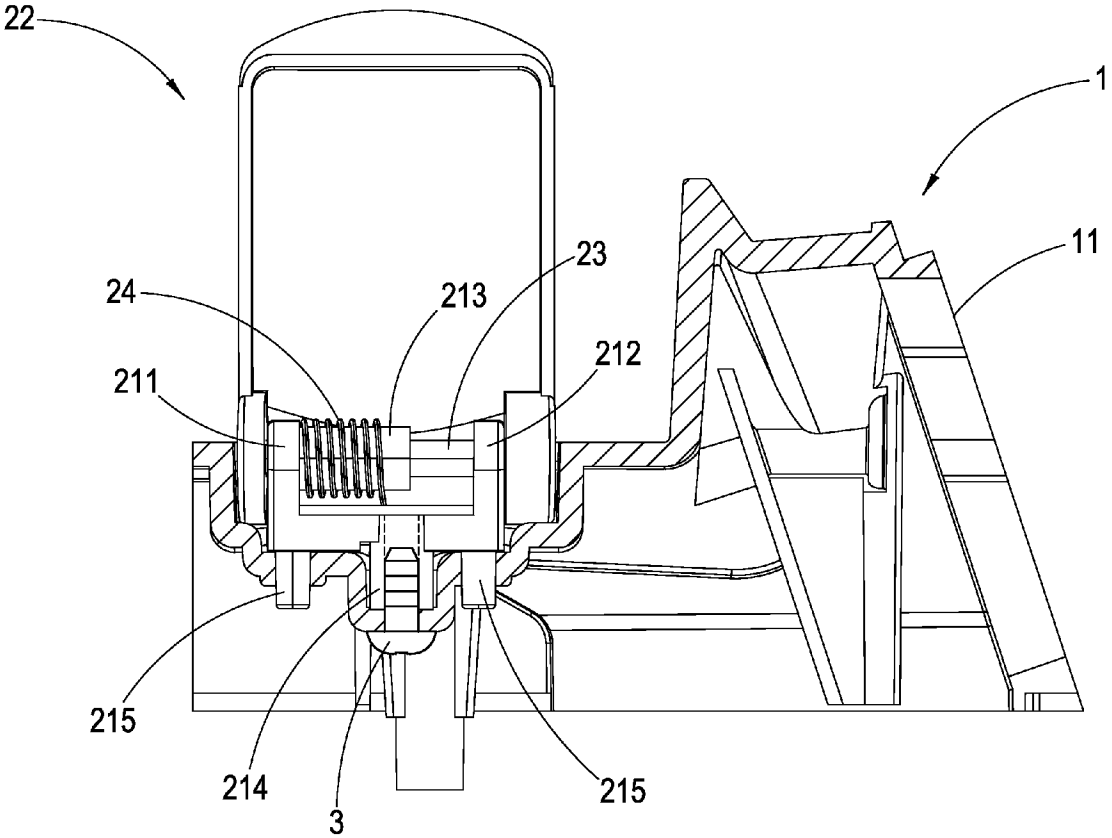
FIG. 5B shows a cross-section view for the combination of the protective lid structure and the socket body in the outdoor power socket having protective lid structure according to the present invention.

Furthermore, the pivotal axle 23 includes a cap part 231 and an axle part 232, in which the axle part 232 extends from the cap part 231 so the cross-section of the pivotal axle 23 generally demonstrates a "T" shape, as shown in FIGS. 5A and 5B; also, the axle part 232 penetrates the two pivotal holes 2211 of the protective lid 22, the open holes 2111, 2121 of the first connection part 211 and the second connection part 212 as well as the through hole 2131 of the axial rod 213 such that the protective lid 22 and connection element 21 can be combined. Moreover, a torsion spring 24 is sleeve installed on the axial rod 213 of the connection element 21 and includes two endpoints, in which one endpoint 241 is fixed to the connection element 21 and the other endpoint 242 is fixed onto the accommodation part 221 of the protective lid 22. In this way, by means of the torsion spring 24, the protective lid 22 enables an auto-restoration feature, so the protective lid 22 can be flipped over the connection element 21 thereby allowing the protective lid 22 to cover or open the power socket 111.

Compared with other conventional technologies, the outdoor power socket having protective lid structure provided by the present invention further offers the following advantages:

- the present invention allows to install a protective structure on the power socket so that, when needed, the user can flip up the protective lid to open the power socket; on the other hand, after completion of use, it can be unplugged so the protective lid can automatically flip to cover the power socket thereby effectively preventing malfunction conditions caused by weather factors due to long-term exposures to outdoor environment.

Through the aforementioned detailed descriptions for the preferred embodiments according to the present invention, it is intended to better illustrate the characteristics and spirit of the present invention rather than restricting the scope of the present invention to the preferred embodiments disclosed in the previous texts. On the contrary, the objective is to encompass all changes and effectively equivalent arrangements within the scope of the present invention as delineated in the following claims of the present application.

What is claimed is:

1. An outdoor power socket having protective lid structure, comprising:

a socket body, in which the upper end thereof is formed by the combination of a front case and a rear case, a plurality of power sockets are installed on the front case and one side of the power sockets has a recessed combination part, and in which a positioning part is at least installed on the combination part and at least a side of the positioning part is configured with a fixation hole;

a connection element, whose left and right sides are configured in protrusion with a first connection part and a second connection part, in which the first connection part and the second connection part respectively includes an open hole and an axial rod laterally extends from an end of the first connection part toward the second connection part, which axial rod having a through hole penetrating to the open hole in the first connection part, and in which a positioning pillar at least extends from the bottom of the connection element and a fixation pillar extends from at least a side of the positioning pillar;

a protective lid, whose bottom is configured with an accommodation part, in which the left and the right sides of the accommodation part respectively include a pivotal hole such that the first connection part and the second connection part of the connection element can be received between the two pivotal holes of the accommodation part, and the positions of the open holes in the first connection part and the second connection part correspond to the pivotal hole of the accommodation part;

a pivotal axle, which penetrates the two pivotal holes of the protective lid, the open holes of the first connection part and the second connection part as well as the through hole of the axial rod such that the protective lid and connection element can be combined and the protective lid can be flipped over the connection element; and a torsion spring, which is sleeve installed on the axial rod and includes two endpoints, in which one of the endpoints is fixed to the connection element and the other one is fixed onto the accommodation part of the protective lid such that the protective lid enables an auto-restoration feature;

accordingly, the positioning pillar of the connection element can be combined into the positioning part of the front case of the socket body such that the fixation pillar on the connection element can penetrate the fixation hole of the combination part thereby allowing the protective lid to cover or open the power socket.

2. The outdoor power socket having protective lid structure according to claim 1, wherein the bottom of the socket body is combined with a cone through which the socket body can be fixed to outdoor ground.

3. The outdoor power socket having protective lid structure according to claim 1, wherein the positioning part of the socket body is a notch and a hole is configured at the bottom surface of the notch, in which a screw hole is configured in the positioning pillar of the connection element such that the positioning pillar can be received within the notch and the screw hole of the positioning pillar corresponds to the hole in the notch so that the connection element can be fixed into the combination part on one side of the socket body by means of through screw fixations.

4. The outdoor power socket having protective lid structure according to claim 3, wherein the depth of the notch determines the insertion distance of the fixation pillar of the connection element into the socket body.

5. The outdoor power socket having protective lid structure according to claim 1, wherein the two sides on the positioning part of the socket body are respectively configured with a fixation hole and the two sides on the positioning pillar of the connection element are respectively configured with a fixation pillar such that, upon combining the positioning pillar with the positioning part, the fixation pillar penetrates and closes the fixation hole thereby firmly combining the connection element into the combination part.

6. The outdoor power socket having protective lid structure according to claim 1, wherein the pivotal axle includes a cap part and an axle part, in which the axle part extends from the cap part so the cross-section of the pivotal axle generally demonstrates a "T" shape, and the axle part penetrates the two pivotal holes of the protective lid, the open holes of the first connection part and the second connection part as well as the through hole of the axial rod such that the protective lid and connection element can be combined and the protective lid can be flipped over the connection element.

* * * * *